US008425810B2

(12) United States Patent
Ishikawa et al.

(10) Patent No.: US 8,425,810 B2
(45) Date of Patent: Apr. 23, 2013

(54) NANOFIBER PRODUCTION DEVICE AND NANOFIBER PRODUCTION METHOD

(75) Inventors: Kazunori Ishikawa, Osaka (JP); Takahiro Kurokawa, Osaka (JP); Hiroto Sumida, Nara (JP); Masahide Yokoyama, Osaka (JP)

(73) Assignee: Panasonic Corporation, Osaka (JP)

( * ) Notice: Subject to any disclaimer, the term of this patent is extended or adjusted under 35 U.S.C. 154(b) by 28 days.

(21) Appl. No.: 13/146,702

(22) PCT Filed: Jan. 19, 2010

(86) PCT No.: PCT/JP2010/000245

§ 371 (c)(1),
(2), (4) Date: Jul. 28, 2011

(87) PCT Pub. No.: WO2010/089955

PCT Pub. Date: Aug. 12, 2010

(65) Prior Publication Data

US 2011/0278751 A1 Nov. 17, 2011

(30) Foreign Application Priority Data

Feb. 5, 2009 (JP) ..... 2009-025329

(51) Int. Cl.
*D04H 1/72* (2012.01)

(52) U.S. Cl.
USPC ..... 264/6; 264/8; 264/10; 264/465; 425/6; 425/8; 425/174.8 E

(58) Field of Classification Search ..... None
See application file for complete search history.

(56) References Cited

U.S. PATENT DOCUMENTS

| | | | |
|---|---|---|---|
| 2002/0122840 | A1 | 9/2002 | Lee et al. |
| 2004/0030377 | A1 | 2/2004 | Dubson et al. |
| 2004/0053553 | A1 | 3/2004 | Dubson et al. |
| 2010/0072674 | A1 | 3/2010 | Takahashi et al. |
| 2010/0148405 | A1 | 6/2010 | Sumida et al. |

FOREIGN PATENT DOCUMENTS

| | | |
|---|---|---|
| JP | 2002-201559 | 7/2002 |
| JP | 2004-530054 | 9/2004 |
| JP | 2006-283240 | 10/2006 |
| JP | 2008-303496 | 12/2008 |
| JP | 2009-024294 | 2/2009 |
| WO | 02/49535 | 6/2002 |
| WO | 02/49536 | 6/2002 |
| WO | 02/49678 | 6/2002 |
| WO | 2008/062784 | 5/2008 |
| WO | 2008/142845 | 11/2008 |

OTHER PUBLICATIONS

International Search Report issued Mar. 2, 2010 in International (PCT) Application No. PCT/JP2010/000245.

*Primary Examiner* — Mary F Theisen
(74) *Attorney, Agent, or Firm* — Wenderoth, Lind & Ponack, L.L.P.

(57) ABSTRACT

A nanofiber production device produces nanofibers by stretching, in a space, a solution. The nanofiber production device includes: an effusing body which effuses the solution into the space by centrifugal force; a driving source which rotates the effusing body; a supplying electrode which is placed at a predetermined distance from the effusing body and supplies charge to the solution via the effusing body; a charging electrode to which a potential of reverse polarity to a polarity of the effusing body is applied, with the charging electrode being placed at a predetermined distance from the effusing body; and a charging power source which applies a predetermined voltage between the supplying electrode and the charging electrode.

6 Claims, 8 Drawing Sheets

NANOFIBER PRODUCTION DEVICE AND NANOFIBER PRODUCTION METHOD

TECHNICAL FIELD

The present invention relates to nanofiber production devices and nanofiber production methods, and in particular to a nanofiber production device and a nanofiber production method that allow increased device durability and nanofiber production efficiency.

BACKGROUND ART

Electrospinning (electric charge induced spinning) is known as a method for producing filamentous (fibrous form) substances (nanofibers) made of polymeric substances or the like and having a diameter in a submicron scale.

In the electrospinning method, a solution, which is a raw material liquid prepared by dispersing or dissolving polymeric substances or the like in a solvent, is effused (ejected) into a space through a nozzle or the like, while charging the solution by applying an electric charge. The solution traveling in the space is electrically stretched, and nanofibers are thus produced.

Following describes the electrospinning method more specifically. The solution which is electrically charged and effused into the space gradually loses solvent through evaporation while traveling in the space. With this, volume of the traveling solution gradually decreases. On the other hand, the electric charge applied to the solution remains in the solution. As a result, charge density of the solution traveling in the space gradually increases. Since the solvent continuously evaporates, the charge density of the solution further increases. When Coulomb force, which is generated in the solution and acts oppositely, exceeds the surface tension of the solution, the solution undergoes a phenomenon in which the polymer solution is explosively stretched into filament (hereinafter referred to as the electrostatic stretching phenomenon). Such electrostatic stretching phenomenon repeatedly occurs at an exponential rate in the space, thereby producing nanofibers made of polymeric substances with a submicron diameter.

When the electrospinning method thus described is adopted, it is possible to increase a yield of the nanofibers by effusing a large amount of the solution into the space. However, for example, when many nozzles are arranged as the device described in Patent Literature (PTL) 1, a problem occurs. For example, potential of the nozzles to which a high voltage is applied does not stabilize, and nanofibers are produced only from a part of the solution effused into the space. In view of this, by rotating a cylindrical-container like effusing body, which is for effusing the solution, and causing the solution to be effused from holes, which are circumferentially provided on the effusing body, by centrifugal force, the inventors of the present invention successfully effused a large amount of the solution. In addition, the inventors have confirmed that electrostatic stretching phenomenon is observed for most of the large amount of solution effused, and nanofibers are produced. In addition, to charge the solution, which is effused into the space by the centrifugal force, electric charge needs to be supplied to the solution via the effusing body which rotates. In view of this, the inventors adopt a structure in which a brush attachable to a motor contacts the effusing body so that electric charge is supplied to the solution.

CITATION LIST

Patent Literature

[PTL 1]
Japanese Unexamined Patent Application Publication No. 2002-201559

SUMMARY OF INVENTION

Technical Problem

However, as a result of devoted experiments, the inventors of the present invention have found that, with wear of a part where friction occurs between the brush and the effusing body, conductivity of the rotating effusing body deteriorates, and quality of the produced nanofibers deteriorates in proportion to the progress of the wear. To reduce the wear, it is possible to consider adopting a brush having high durability. However, with the cost of the material itself and the complex structure required to be adopted, there is a problem of increasing the cost of the device. Also, in any of the above cases, replacement of the brush and the effusing body is inevitable, causing an increase in the running cost of the device. Furthermore, the inventors have found that dust is generated at the part where wear occurs, and can adversely affect the produced nanofibers.

In view of this, as a result of studies and experiments, the inventors of the present invention have found a structure and a method which enables the of supply electric charge to the effusing body without generating friction, and thus completed the present invention. In other words, the object of the present invention is to provide a nanofiber production device and a nanofiber production method in which wear does not occur at a part where electric charge is supplied to the effusing body that rotates.

Solution to Problem

In order to achieve the objects described above, a nanofiber production device according to the present invention is a nanofiber production device which produces nanofibers by stretching, in a space, a solution. The nanofiber production device includes: an effusing body which effuses the solution into the space by centrifugal force; a driving source which rotates the effusing body; a supplying electrode which supplies charge to the solution via the effusing body, the supplying electrode being placed at a predetermined distance from the effusing body; a charging electrode to which a potential of reverse polarity to a polarity of the effusing body is applied, the charging electrode being placed at a predetermined distance from the effusing body; and a charging power source which applies a predetermined voltage between the supplying electrode and the charging electrode.

With this, since the effusing body and the supplying electrode do not contact each other but are placed at a predetermined distance from each other, friction is not generated at a part where electric charge is supplied.

It is to be noted that the reason why electric charge is supplied to the effusing body from the supplying portion, which is placed at a predetermined distance from the effusing body, is not completely clear. However, it is considered that the electric charge is supplied to the effusing body as follows. When voltage is applied between the supplying electrode and the charging electrode, electric charge (electron) is unevenly distributed inside the effusing body. In the effusing body, electric charge with a potential opposite to that of the supplying electrode is concentrated on a part near the supplying electrode. From the supplying electrode to which a high voltage is applied, an ion wind is generated. The part of the effusing body which has a potential opposite to that of the supplying electrode attracts the ion wind, and carries away the electric charge from the ion wind. Since the electric charge that has been carried away has a potential opposite to that of the charging electrode, the electric charge is attracted to the charging electrode side. The attracted electric charge is given to the solution, and effused into the space together with the solution. Thus, the effusing body runs short of the electric charge, and further carries away the electric charge from the ion wind generated from the supplying electrode.

Through repetition of the above, it is considered that the effusing body is constantly supplied with the electric charge. In other words, between the supplying electrode and the effusing body that are placed at a predetermined distance from each other, that is, even through the supplying electrode and the effusing body do no contact each other, it is considered that the charging power source can keep supplying the electric charge via the ion wind generated in the air.

Preferably, the supplying electrode includes a pointed portion which is sharp at a tip and oriented toward the effusing body.

With this, a large amount of ion wind is generated from the pointed portion, and it is considered that electric charge can be supplied efficiently.

Preferably, the pointed portion extends toward the effusing body and consists of a plurality of members each having a needle-shaped tip or a thread-shaped tip.

With this, ion wind is generated from a tip of each of the needle-shaped members, and thus it is considered that the supplying electrode can supply electric charge even more efficiently.

The effusing body may include, in a portion opposing the supplying electrode, a receiving portion which is sharp at a tip and protrudes in a radial direction.

In this case, too, it is considered that ion wind is generated from the receiving portion, and electric charge is supplied via the ion wind.

Further, preferably, the nanofiber production device includes: a gas flow generating device which generates a gas flow that (i) changes a direction of the solution effused from the effusing body and (ii) transports the nanofibers produced in the space; and a wind control portion which controls the gas flow generated by the gas flow generating device such that the gas flow does not pass through between the supplying electrode and the effusing body.

With this, it is possible to prevent the gas flow from adversely affecting the ion wind, which allows the nanofiber production device to maintain efficiency in supplying charge via the ion wind.

Advantageous Effects of Invention

According to the present invention, it is possible to eliminate contact between the supplying electrode, which supplies electric charge to the effusing body, and the effusing body, and the electric charge is supplied to the effusing body without generating friction.

DESCRIPTION OF EMBODIMENT

Following describes an embodiment of a nanofiber production device according to the present invention with reference to the drawings.

Figure 1:
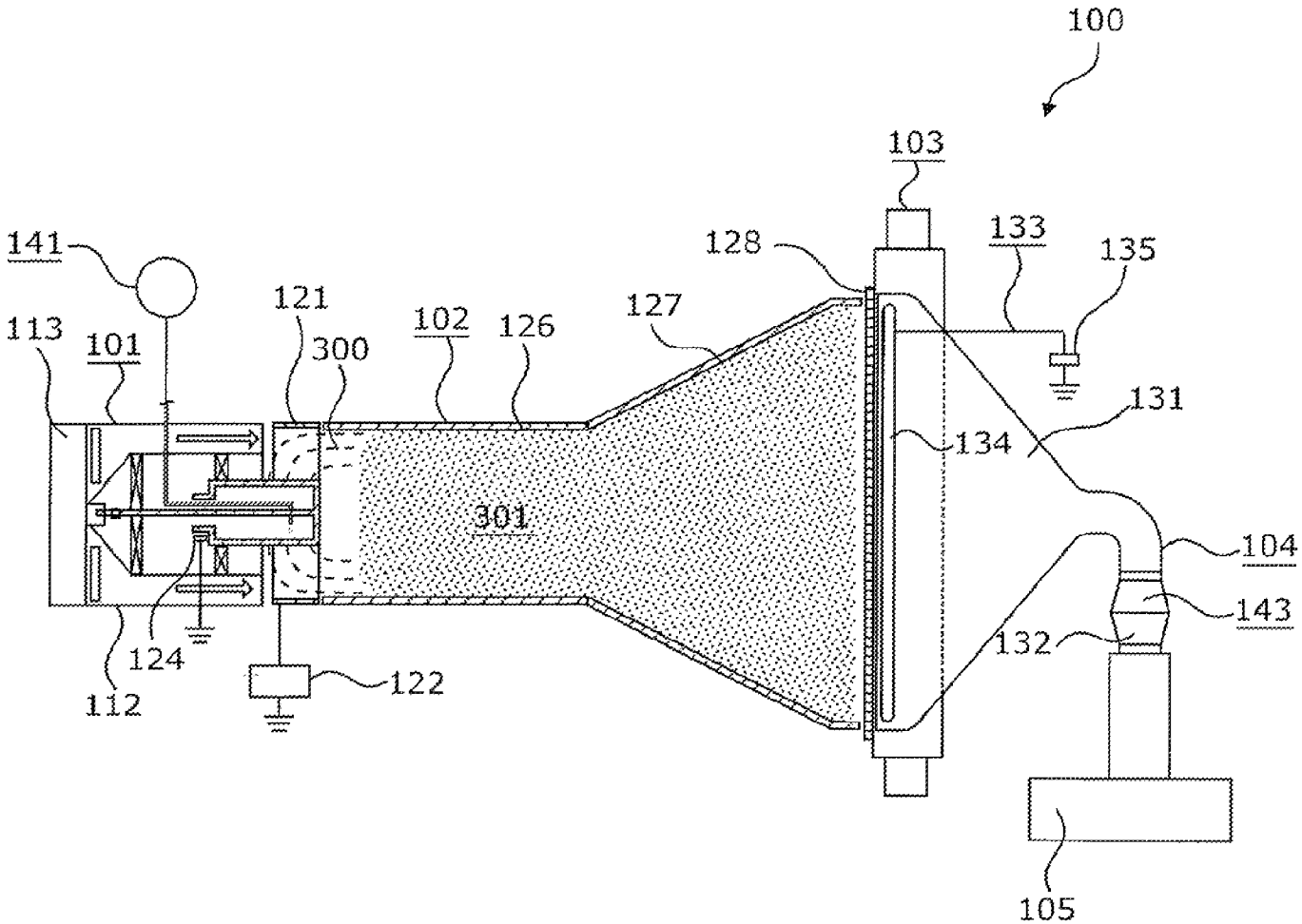
FIG. 1 is a partially cutaway plan view of an embodiment of a nanofiber production device.

FIG. 1 is a partially cutaway plan view of an embodiment of the nanofiber production device.

As shown in FIG. 1, a nanofiber production device 100 includes: a discharging device 101, a guiding body 102, a collecting device 103, an attracting device 104, and a gas flow generating device 113.

Note that a raw material liquid used for producing the nanofibers is referred to as the solution 300, and the produced nanofibers are referred to as the nanofibers 301. However, the solution 300 changes to the nanofibers 301 while electrically stretched in the production of the nanofibers; and thus, the border between the solution 300 and the nanofibers 301 is ambiguous and they cannot be clearly distinguished from each other.

The discharging device 101 is a unit which can discharge, by gas flow, the solution 300 which is charged and nanofibers 301 are produced.

Figure 2:
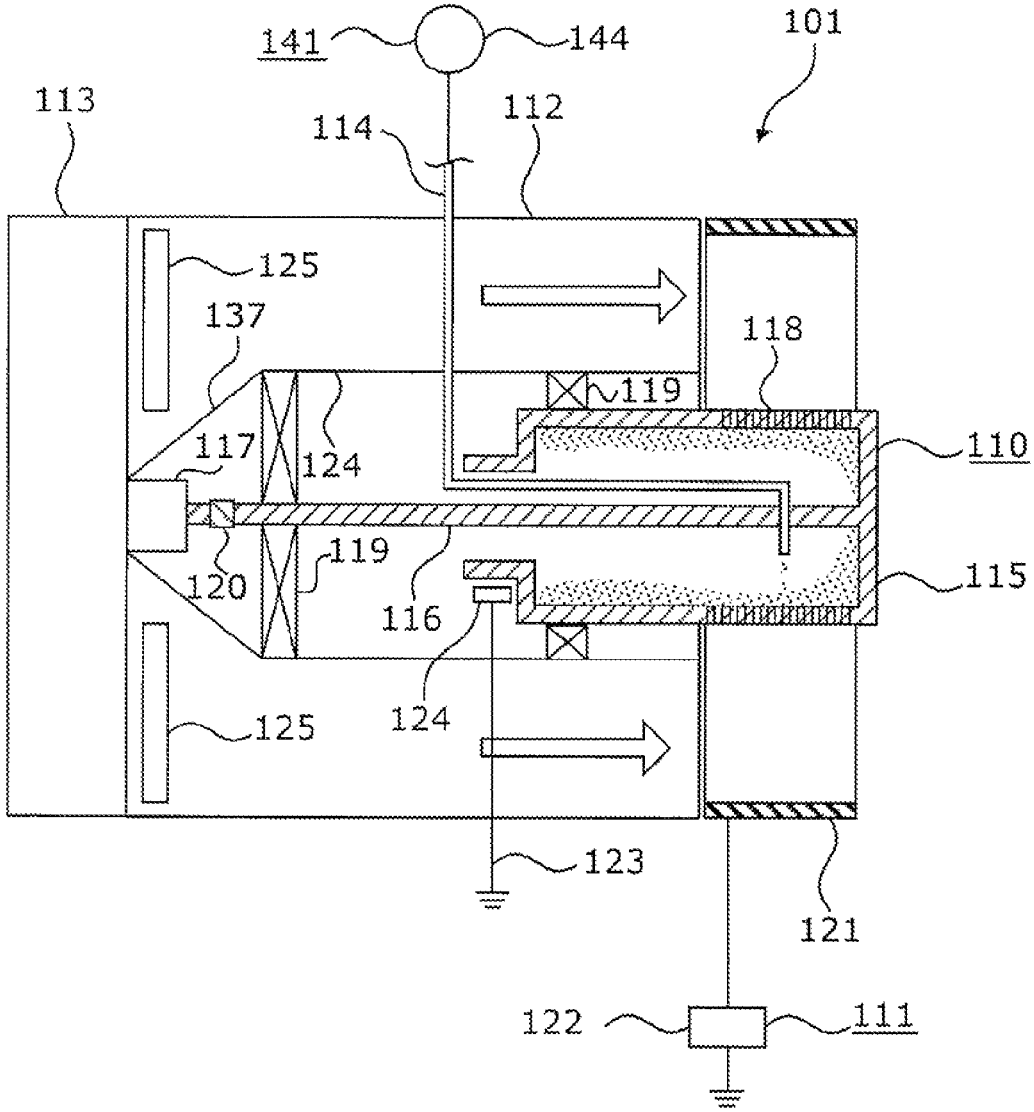
FIG. 2 is a partially cutaway plan view of a discharging device.

FIG. 2 is a partially cutaway plan view of the discharging device.

Figure 3:
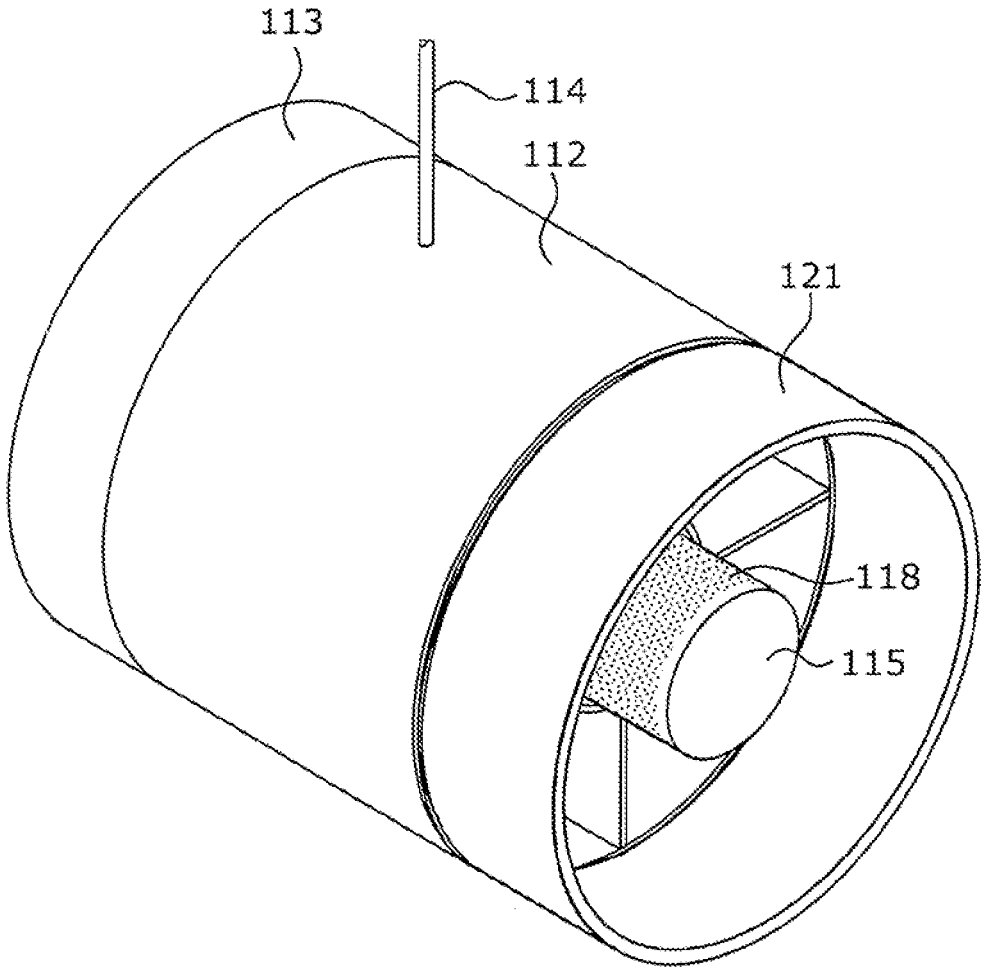
FIG. 3 is a perspective view of the discharging device.

FIG. 3 is a perspective view of the discharging device.

As shown in these drawings, the discharging device 101 includes: an effusing device 110, a charging device 111, an air channel 112, the gas flow generating device 113, and a supplying device 141.

The effusing device 110 is a device which effuses the solution 300 into the space. In this embodiment, the effusing device 110 radially effuses the solution 300 by centrifugal force. The effusing device 110 includes an effusing body 115, a rotary shaft 116, and a driving source 117.

The effusing body 115 is a member for effusing the solution 300 into the space, and includes a plurality of effusion holes 118 for allowing the solution 300 to pass through. In this embodiment, the effusing body 115 is a container which can effuse the solution 300 into the space by the centrifugal force caused by rotation of the effusing body 115 while the solution 300 is supplied inside. The effusing body 115 has a cylindrical shape whose one end is closed, and includes the effusion holes 118 on its circumferential wall. The effusing body 115 is made of a conductive material so that an electric charge can be supplied to the solution 300 contained inside. The effusing body 115 is pivotally supported by a bearing 119.

More particularly, it is preferable that a diameter of the effusing body 115 is set within a range of not less than 10 mm to not more than 300 mm. This is because, if the diameter is too large, causing an after-mentioned gas flow to concentrate the solution 300 or the nanofibers 301 is unlikely. It is also because, if the weight balance is unbalanced even slightly, such as a case in which the rotary shaft of the effusing body 115 is decentered, a significant vibration is caused, requiring a structure to support the effusing body 115 firmly to suppress such a vibration. On the other hand, if the diameter is too small, it is necessary to increase the number of rotations of the effusing body 115 so that the solution 300 is effused by the centrifugal force. This causes problems associated with, for example, extra loads or vibrations of the driving source. Further, it is preferable that the diameter of the effusing body 115 is set within a range of not less than 20 mm to not more than 150 mm.

Further, it is preferable that the shape of the effusion hole 118 is circular. The preferred diameter of the effusion hole 118 depends on the thickness of the effusing body 115, but it is preferably set within a range of approximately not less than 0.01 mm to not more than 3 mm. This is because, if the effusion holes 118 are too small, effusing the solution 300 outside the effusing body 115 is unlikely, and if the effusion holes are too large, the amount of the solution 300 effused from each effusion hole 118 per unit time is too much (that is, the thickness of the filament formed by the effused solution 300 is too large) and the nanofibers 301 with desired diameter are difficult to produce.

The shape of the effusing body 115 from which the solution 300 is effused by the centrifugal force is not limited to the cylindrical shape, but may be a polygonal column shape having a polygonal cross section, a conic shape, or the like. The effusing body 115 may be in any shape as long as the solution 300 can be effused through the effusion holes 118 by the centrifugal force caused by the rotation of the effusing body 115. Further, the shape of the effusion holes 118 is not limited to circular, but may be polygonal, star like shape, or the like.

The rotary shaft 116 is a shaft which transmits a drive force for rotating the effusing body 115 so as to effuse the solution 300 by the centrifugal force. The rotary shaft 116 has a rod shape and is inserted into the effusing body 115 from one end of the effusing body 115. One end of the rotary shaft 116 is connected with the closed portion of the effusing body 115. Further, the other end of the rotary shaft 116 is connected to a rotary shaft of the driving source 117 which is a driving source. The rotary shaft 116 is connected with the driving source 117 via an insulating material 120, and thus the effusing body 115 and the driving source 117 are electrically isolated.

This is for protecting the driving source 117 when the effusing body 115 is disconnected from a ground due to an accident or the like. The rotary shaft 116 is pivotally supported by the bearing 119.

The driving source 117 is a device which applies a rotation drive force to the effusing body 115 via the rotary shaft 116 for effusing the solution 300 through the effusion holes 118 by the centrifugal force. It is preferable that the number of rotations of the effusing body 115 is set within a range of not less than a few rpm to not more than 10000 rpm depending on, for example, the bore of the effusion holes 118, viscosity of the solution 300 to be used, or types of polymeric substances in the solution. When the effusing body 115 is directly driven by the driving source 117 as in this embodiment, the number of rotations of the driving source 117 corresponds to the number of rotations of the effusing body 115.

The charging device 111 is a device which electrically charges the solution 300 by supplying an electric charge to the solution 300. In this embodiment, as shown in FIGS. 1 to 3, the charging device 111 includes: a charging electrode 121, a charging power source 122, a grounding device 123, and a supplying electrode 124.

The charging electrode 121 is a member for inducing electric charges on the effusing body 115 by having a voltage higher or lower than the effusing body 115. The charging electrode 121 is an annular member provided so as to surround the tip of the effusing device 110, and has a circular cross section. When a positive voltage is applied to the charging electrode 121, a negative charge is induced to the effusing device 110, and when a negative voltage is applied to the charging electrode 121, a positive charge is induced to the effusing device 110.

The charging electrode 121 needs to be larger than the diameter of a tip of the effusing device 110. It is preferable that the diameter of the charging electrode 121 is set within a range of not less than 50 mm to not more than 1500 mm. Note that the shape of the charging electrode 121 is not limited to an annular shape, but may be a polygonal annular shape, a flat plate shape or the like depending on the shape of the effusing device 110. Further, the cross-sectional shape of the charging electrode 121 is not limited to a circle, but may be rectangular.

The grounding device 123 is a member which is electrically connected to the effusing device 110 and can maintain the effusing device 110 at a ground potential level. One end of the grounding device 123 is connected to the supplying electrode 124, and the other end of the grounding device 123 is connected to the ground.

Figure 4:
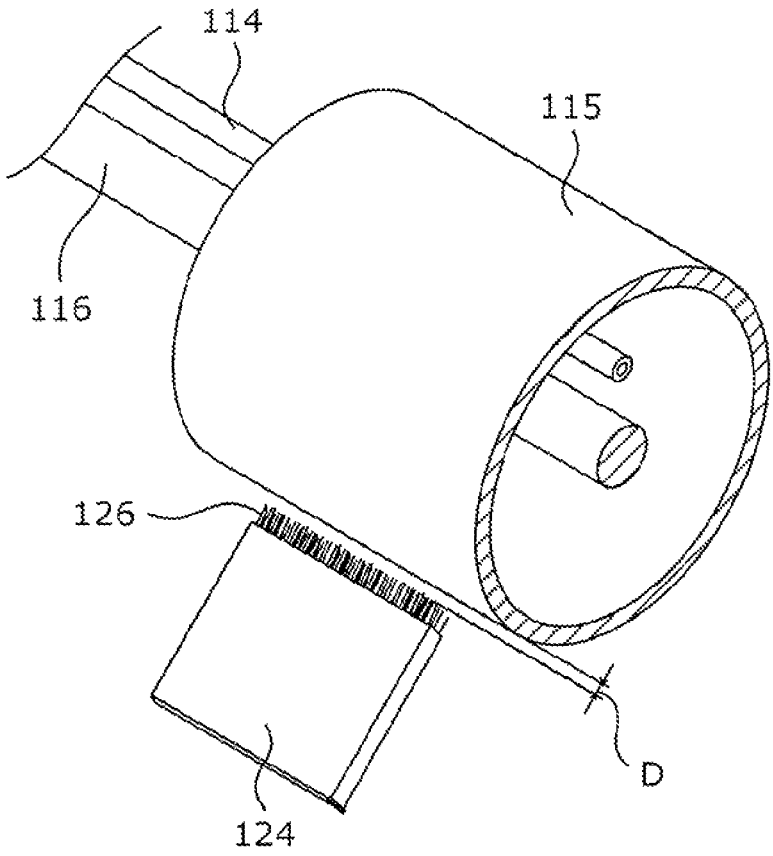
FIG. 4 is a perspective view showing proximity of a supplying electrode.

FIG. 4 is a perspective view showing proximity of the supplying electrode.

Figure 5:
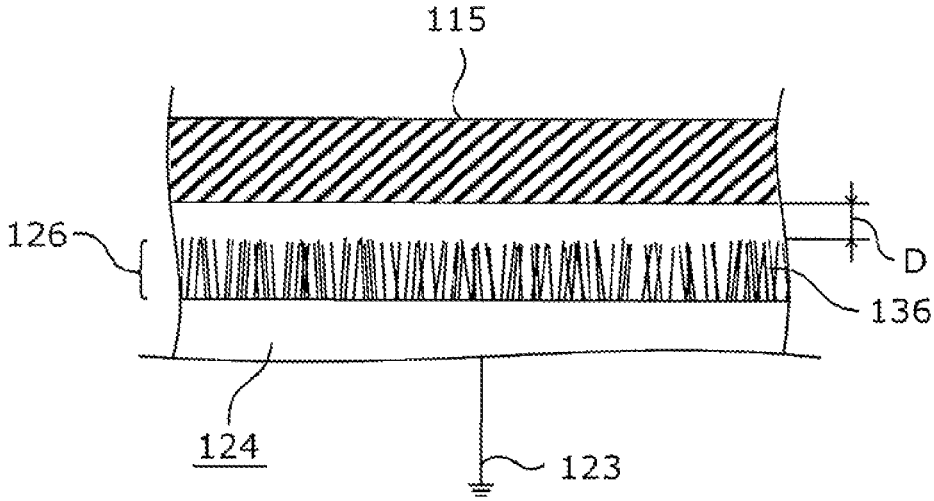
FIG. 5 is a lateral view showing a pointed portion of the supplying electrode.

FIG. 5 is a lateral view showing a pointed portion of the supplying electrode.

As shown in these drawings, the supplying electrode 124 is an electrode which supplies electric charge to the solution 300 via the effusing body 115, and is placed at a predetermined distance D from the effusing body 115. In addition, the supplying electrode 124 includes, in a portion opposing the effusing body 115, a pointed portion 126 which is a tip. In this embodiment, the pointed portion 126 consists of a plurality of members each having a needle-shaped tip or a thread-shaped tip. The members 136 extend toward the effusing body 115, and a tip of each of the members 136 serves as the pointed portion 126 which is sharp at a tip and oriented toward the effusing body 115.

The distance D refers to a distance between the supplying electrode 124 and the effusing body 115 (in this embodiment, a distance between the tip of the members 136 and the effusing body 115). It is preferable that the distance D is not more than 2 mm. When the distance D is longer than 2 mm, a probability of the ion wind, which is generated from the supplying electrode 124, reaching the effusing body 115 is decreased. This makes it difficult to cause the solution 300 to be effectively charged. In other words, by making the distance D 2 mm or less, even when the supplying electrode and the effusing body are spaced from each other, conduction between the supplying electrode and the effusing body is ensured. This makes it possible to cause the solution 300 to be effectively charged. Also, it is sufficient that the lower limit of the distance D is set such that the supplying electrode 124 and the effusing body 115 do not contact each other. It is to be noted that a case where the members 136 of the supplying electrode 124 and the effusing body 115 are initially in contact with each other is also intended to be within the scope of the present invention, provided that the supplying electrode 124 and the effusing body 115 become separated from each other due to the wear of tips of the members 136 in contact with the effusing body 115, which is caused by the rotation of the effusing body 115. Also, when the rotary shaft 116 and the effusing body 115 are connected and are in contact with each other with electrical conductivity, the same advantage is obtained by arranging the supplying electrode 124 so as to oppose the rotary shaft 116. In other words, "a supplying electrode which supplies charge to the solution via the effusing body, the supplying electrode being placed at a predetermined distance from the effusing body" includes not only the supplying electrode 124 placed close to the effusing body 115 but also the supplying electrode 124 placed close to a member such as the rotary shaft 116 which is electrically connected to the effusing body 115 and rotates in the same manner as the effusing body 115. Also, any member that is electrically connected to the effusing body 115 and rotates may be considered to be the effusing body 115.

The charging power source 122 is a power source which can apply a high voltage between the charging electrode 121 and the supplying electrode 124. In this embodiment, direct-current power supply is adopted as the charging power source 122. It is preferable that the direct-current power supply is adopted when the electric charge of the nanofibers 301 produced in the space is used, and an electric field is used to attract the nanofibers 301. Further, when the charging power source 122 is a direct-current power supply, it is preferable that a voltage to be applied between the charging electrode 121 and the supplying electrode 124 is set within the range from not less than 10 kV to not more than 200 kV. Note that, in this embodiment, the charging power source 122 is not directly connected between the charging electrode 121 and the supplying electrode 124. Instead, the supplying electrode 124 side is grounded, and a voltage is applied to the charging electrode 121 with respect to a ground potential using the charging power source 122. Thus, a voltage is applied between the charging electrode 121 and the supplying electrode 124. Accordingly, depending on a polarity connected to the charging power source 122, it is selectable whether the charging electrode 121 becomes negative high voltage or positive high voltage with respect to the supplying electrode 124. Setting may be made arbitrarily, that is, for example, when the nanofibers 301 are prone to be positively charged, the charging electrode 121 may be set to have a negative polarity; and, when the nanofibers 301 are prone to be negatively charged, the charging electrode 121 may be set to have a positive polarity.

Note that which one of the charging electrode 121 and the supplying electrode 124 is to be grounded, or both the charging electrode 121 and the supplying electrode 124 are to be in a floating state without grounding can also be set arbitrarily.

Further, the effusing body 115 and the charging electrode 121 may be placed arbitrarily, and thus the voltage applied by the charging power source 122 may be adjusted according to the position of the effusing body 115 and the charging electrode 121. More specifically, it is preferable that a voltage to be applied is adjusted such that the electric field strength is 1 kV/cm or more in a space where a distance between the charging electrode 121 and the effusing body 115 (proximity of the effusion holes 118) is the closest.

Note that the nanofibers 301 can also be produced by applying alternating-current voltage between the supplying electrode 124 and the charging electrode 121, and alternating-current voltage may be superimposed onto direct-current voltage of high voltage.

The supplying device 141 is a device which supplies the solution 300 into effusing device 110, and includes a supply path 114 and a supplying source 144 (see FIG. 2).

The supply path 114 is a pathway for supplying the solution 300 to an inside of the effusing body 115 from the supplying source 144 which is placed outside. In this embodiment, the supply path 114 is made of a tube.

The supplying source 144 is a device which includes a tank for storing the solution 300, and a pump for supplying the solution 300 at a predetermined pressure.

The gas flow generating device 113 is a device which generates the gas flow for transporting the solution 300, which is effused from the effusing device 110 into the space, and the nanofibers 301 being produced. The gas flow generating device 113 is provided at the rear side of the driving source 117, and generates gas flow directed toward the tip of the effusing device 110 from the driving source 117. The gas flow generating device 113 is capable of generating force which changes, into the axial direction, the direction of the solution 300 effused from the effusing device 110. In FIG. 2, the gas flow is indicated by white arrows. An example of the gas flow generating device 113 is a blower that includes an axial flow fan.

Note that the gas flow generating device 113 may be made of other types of blowers such as a sirocco fan. In addition, the gas flow generating device 113 may generate gas flow inside the air channel 112 by an after-mentioned drawing device 132. In this case, the nanofiber production device 100 does not include the gas flow generating device 113 for actively generating gas flow; however, it is considered that the nanofiber production device 100 has the gas flow generating device 113 as long as gas flow is generated inside the air channel 112 or the like by some sort of device.

The air channel 112 is a duct for guiding gas flow generated by the gas flow generating device 113 to an area between the charging electrode 121 and the effusing device 110. In this embodiment, the gas flow guided by the air channel 112 passes through an inside of the charging electrode 121 transporting the solution 300 effused from the effusing device 110.

Furthermore, the discharging device 101 includes a wind control portion 137 and a heating device 125.

The wind control portion 137 has a function to control the gas flow generated by the gas flow generating device 113 such that the gas flow does not flow into a space between the supplying electrode 124 and the effusing body 115 obstructing the transportation of the electric charge. In this embodiment, an air path, which guides the gas flow to travel to a specific area, is used as the wind control portion 137. The wind control portion 137 prevents the gas flow from directly hitting the space between the supplying electrode 124 and the effusing body 115; and thus, it is possible to prevent the ion wind that is generated between the supplying electrode 124 and the effusing body 115 from getting flowed away and getting neutralized. Thus, the wind control portion 137 allows the electric charge to be stably supplied between the supplying electrode 124 and the effusing body 115.

The heating device 125 is a heating source which heats gas forming the gas flow generated by the gas flow generating device 113. In this embodiment, the heating device 125 is an annular heater provided inside the air channel 112, and is capable of heating gas which passes through the heating device 125. By heating the gas flow using the heating device 125, evaporation of the solution 300 effused into the space is facilitated, and the nanofibers 301 are thereby efficiently produced.

Figure 6:
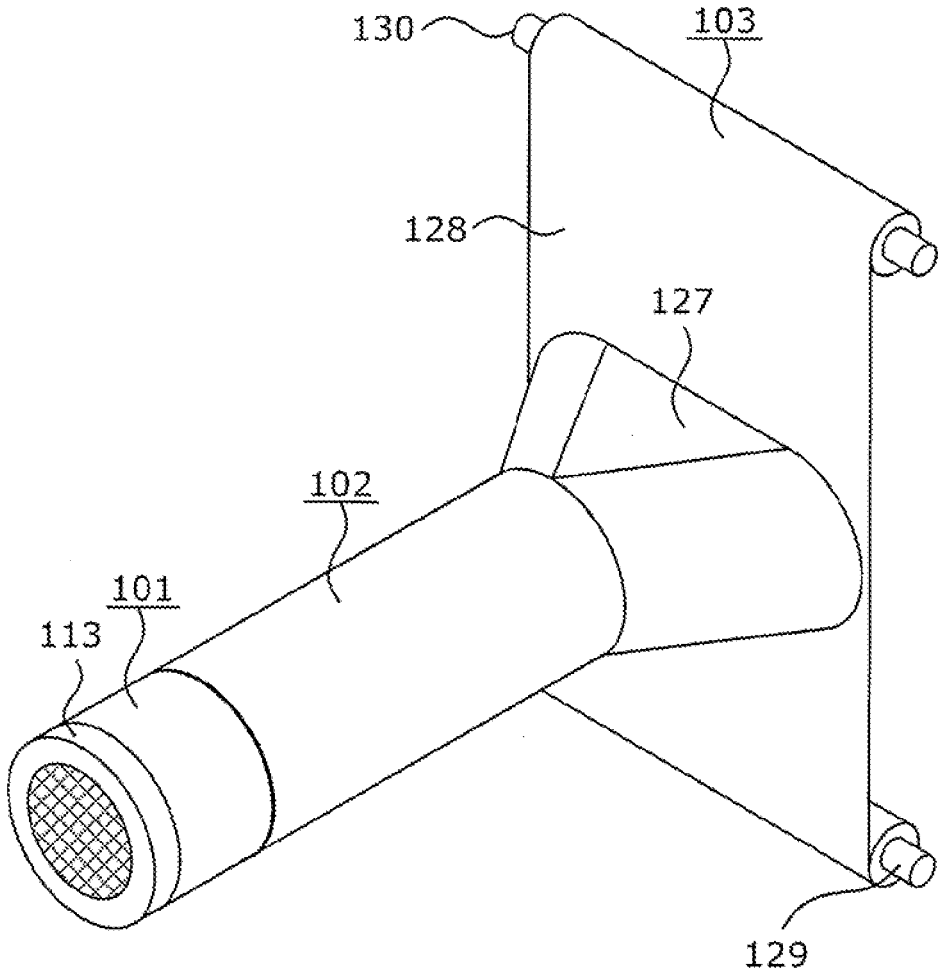
FIG. 6 is a perspective view showing proximity of a guiding body.

FIG. 6 is a perspective view showing proximity of the guiding body.

As shown in FIG. 6, the guiding body 102 is an air channel which guides, to a specific area, the nanofibers 301 that are discharged from the discharging device 101 and transported by the gas flow.

The diffusing body 127 is a duct connected to the guiding body 102, and widely and evenly diffuses the nanofibers 301 in a high density state into a low density state. The diffusing body 127 is a hood shaped member that smoothly and continuously enlarges the space to which the nanofibers 301 are guided, and thereby gradually decreases the speed of the gas flow, which transports the nanofibers 301, and the nanofibers 301. In this embodiment, the hood shape of the diffusing body 127 is such that the height is maintained to be the same as that of the guiding body 102, and only the width becomes gradually wider.

The collecting device 103 is a device which collects the nanofibers 301 discharged from the guiding body 102. In this embodiment, the collecting device 103 includes the substrate 128, a winding device 129, and a substrate supplying device 130.

The substrate 128 separates the nanofibers 301, which are produced through the electrostatic stretching phenomenon and transported by the gas flow, from the gas flow. On the substrate 128, only the nanofibers 301 are deposited. In this embodiment, the substrate 128 is an elongated sheet-like member, which is thin and flexible, made of materials easily separable from the deposited nanofibers 301, and is a net-like member which can collect nanofibers 301 and readily allow the gas flow to pass through. More specifically, an example of the substrate 128 is an elongated cloth made of aramid fiber. Further, Teflon (registered trademark) coating on the surface of the substrate 128 is preferable since it enhances removability when removing the deposited nanofibers 301 from the substrate 128. The substrate 128 is supplied from the substrate supplying device 130 where it is wound in a roll.

The winding device 129 is a device which can move the substrate 128. In this embodiment, the winding device 129 winds the elongated substrate 128 and simultaneously unwinds the substrate 128 from the substrate supplying device 130, and transports the substrate 128 together with the deposited nanofibers 301. The winding device 129 can wind the nanofibers 301 deposited in a non-woven fabric like state, together with the substrate 128.

The attracting device 104 is, as shown in FIG. 1, a device for attracting the nanofibers 301 onto the substrate 128. In this embodiment, to allow different types of attracting methods to be used simultaneously or to allow the attracting methods to be selectively used, the attracting device 104 includes a gas attracting device 143 and an electric field attracting device 133.

The gas attracting device 143 is a device which attracts the nanofibers 301 onto the substrate 128 by drawing the gas flow, and is placed behind the substrate 128. In this embodiment, the gas attracting device 143 includes the drawing device 132 and a concentrating body 131.

The concentrating body 131 is a member which receives the gas flow that is diffused while passing through the diffusing body 127, and concentrates the gas flow before the gas flow reaches the drawing device 132. The concentrating body 131 is funnel-shaped in the opposite direction as the diffusing body 127.

The drawing device 132 is a blower which forcibly draws gas flow which passes through the substrate 128. The drawing device 132 is a blower such as a sirocco fan or an axial flow fan, and is capable of accelerating, to a high speed, the gas flow which is decelerated after passing through the substrate 128.

The electric field attracting device 133 is a device which attracts, by an electric field, the charged nanofibers 301 to the substrate 128, and includes an attracting electrode 134 and an attraction power source 135.

The attracting electrode 134 is an electrode for generating an electric field that induces the charged nanofibers 301. In this embodiment, as the attracting electrode 134, a metal net which can allow the gas flow to pass through is adopted. The attracting electrode 134 is provided at the opening of the diffusing body 127, and is approximately the same size as the diffusing body 127.

The attraction power source 135 is a direct-current power supply that can maintain the attracting electrode 134 at a certain voltage and with a certain polarity. In this embodiment, the attraction power source 135 is a direct-current power supply that can change a voltage and a polarity freely in a range from 0 V (ground state) to 200 kV.

It is to be noted that although a metal net is adopted as the attracting electrode 134 in this embodiment, the attracting electrode is not limited to this. Other material having a certain width about equal to the width of the substrate 128 may be used as the attracting electrode. When drawn by the drawing device 132, together with an attraction by the attracting electrode, nanofibers are drawn onto the substrate 128 by the gas flow. With this, even when a flammable solvent or a high-density solvent is used, the solvent is not concentrated to the level that would cause an explosion. Thus, the device can be used at ease.

Note that the attraction power source 135 may be an alternating-current power supply, when the charging power source 122 is an alternating-current power supply.

A retrieving device 105 is a device which separates and retrieves, from the gas flow, the solvent evaporated from the solution 300. The retrieving device 105 varies depending on the type of a solvent used in the solution 300. Examples of the retrieving device 105 are: a device which retrieves the solvent by lowering a temperature of a gas and causing a condensation of a solvent; a device which causes only a solvent to be adsorbed using active charcoal or zeolite; a device which causes a solvent to be dissolved in a liquid or the like; or any combination of these devices.

Here, examples of polymeric substances constituting the nanofibers 301 include polypropylene, polyethylene, polystyrene, polyethylene oxide, polyethylene terephthalate, polybutylene terephthalate, polyethylene naphthalate, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, polyamide, aramid, polyimide, polycaprolactone, polylactic acid, polyglycolic acid, collagen, polyhydroxybutyric acid, polyvinyl acetate, polypeptide, and copolymer of these. Further, one type selected from the above may be used, or various types may be mixed. Note that these are just examples, and the present invention should not be limited to the above polymeric substances.

Examples of the solvents used for the solution 300 include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, chloroform, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, N,N-dimethylacetamide, dimethyl sulfoxide, pyridine, and water. Further, one type selected from the above may be used, or various types may be mixed. Note that these are just examples, and the present invention should not be limited to the above solvents.

In addition, some additive agent such as aggregate or plasticizing agent may be added to the solution 300. Examples of additive agent include oxides, carbides, nitrides, borides, silicides, fluorides, and sulfides. However, in view of thermal resistance, workability, and the like, oxides are preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. Further, one type selected from the above may be used, or various types may be mixed. Note that these are just examples, and the present invention should not be limited to the above additive agents.

Desirable mixing ratio of solvent and polymeric substances depends on the kinds of the solvent and the polymeric substances, but preferable amount of the solvent is in the range of approximately not less than 60 wt % and not more than 98 wt %.

As described, with the gas flow, solvent vapor does not stay but is processed. Thus, even when the solution 300 contains the solvent of 50 wt % or more, the solvent evaporates sufficiently, allowing the electrostatic stretching phenomenon to occur. Since the nanofibers 301 are produced from the state where the polymeric substance that is solute is thin, thinner nanofibers 301 can also be produced. Further, the adjustable range of the solution 300 can be increased, allowing wider range of performances of the nanofibers 301 to be produced.

Next, a method for producing the nanofibers 301 using the nanofiber production device 100 thus structured is described.

First, the gas flow generating device 113 and the drawing device 132 are activated to cause a gas flow to be generated and flow in constant direction inside the air channel 112, the guiding body 102, the diffusing body 127, and the concentrating body 131 (gas flow generating process). In such a state, the nanofiber production device 100 is adjusted such that a flow rate inside the guiding body 102 becomes 30 cubic meters per minute.

Next, the solution 300 is supplied to inside of the effusing body 115 from a supplying portion 142 using the supplying device 141 (solution supplying process). The solution 300 is supplied to inside of the effusing body 115 through the supply path 114 from the supplying source 144. More specifically, polyurethane is selected as a material of the nanofibers 301, and N,N-dimethylacetamide as a solvent. Here, the mixing ratio is 25 wt % polyurethane and 75 wt % N,N-dimethylacetamide.

Next, the charging electrode 121 is caused to have positive high voltage or negative high voltage using the charging power source 122. In this state, although there is a space between the supplying electrode 124 and the effusing body 115, electric charge is concentrated on the effusing body 115, and the electric charge is transferred to the solution 300, which is effused into the space from the effusion holes 118, and the solution 300 is thus charged (charging process).

While the charging process is being performed, the driving source 117 causes the effusing body 115 to rotate. Thus, the solution is effused into the space by centrifugal force (effusing process).

Specifically, here, an effusing body 115 having an outside diameter of ϕ60 mm at a tip is used. The effusing body 115 has 74 effusion holes 118 that are circumferentially arranged at equal intervals, and a bore of the effusion hole 118 is 0.3 mm. Meanwhile, here, the charging electrode 121 having an inside diameter of ϕ600 mm is used. The charging electrode 121 is caused to have negative 60 kV with respect to the ground potential using the charging power source 122. With this, a positive charge is induced to the effusing body 115, and the solution 300 effused is positively charged. The number of rotations of the effusing body 115 is 1500 rpm. A space between the supplying electrode 124 and the effusing body 115 is approximately 0.5 mm. In this state, 10 μA current is supplied by the charging power source 122.

The solution 300 effused from the effusing body 115 is transported by the gas flow (transporting process), and the solution 300 is guided into the guiding body 102 with the gas flow.

Here, a polarity of a charge state of the solution 300 is opposite to a polarity of the charging electrode 121. Thus, due to an attraction by Coulomb force, the solution 300 tends to travel toward the charging electrode 121. However, most of the solution 300 traveling toward the charging electrode 121 is redirected by the gas flow, and thus travels toward the guiding body.

In addition, the gas flow is heated by the heating device 125. With this, the gas flow applies heat to the solution 300 while guiding the traveling of the solution 300, and thus facilitates the evaporation of the solvent and thus facilitates the electrostatic stretching.

The nanofibers 301 discharged from the discharging device 101 are thus guided into the guiding body 102. Then, the nanofibers 301 are guided toward the collecting device 103 while being transported inside the guiding body 102 by the gas flow (guiding process).

The nanofibers 301 transported to the diffusing body 127 reduce its traveling speed rapidly, and are evenly dispersed (diffusing process).

In this state, the drawing device 132 placed behind the substrate 128 draws the gas flow together with the solvent, which is an evaporated component that is evaporated, so as to attract the nanofibers 301 onto the substrate 128 (attracting process). Also, from the attracting electrode 134 to which a voltage is applied, an electric field is generated. This electric field also attracts the nanofibers 301 (attracting process).

As described above, the nanofibers 301 are separated from the gas flow by the substrate 128, and nanofibers 301 are collected (collecting process). The substrate 128 is slowly transferred by the winding device 129. Thus, the nanofibers 301 are collected as a band shape member that is elongated in a direction of the transfer.

The gas flow which passed through the substrate 128 is accelerated by the drawing device 132, and reaches the retrieving device 105. The retrieving device 105 separates a solvent component from the gas flow, and retrieves the solvent component (retrieving process).

When the thus described nanofiber production method is performed with the thus structured nanofiber production device 100, it is possible to produce the nanofibers 301 with a state where the effusing body 115, which rotates at a high speed, and the supplying electrode 124 do not contact each other.

This means that the effusing body 115 and the supplying electrode 124 do not wear against each other. This eliminates the time, effort and the cost for replacement of the effusing body 115, the supplying electrode 124 and the like. Moreover, dust or the like, which is generated due to the wear and affects quality of the produced nanofibers 301, is eliminated. Thus, it is possible to improve the quality of the nanofibers 301.

Figure 7:
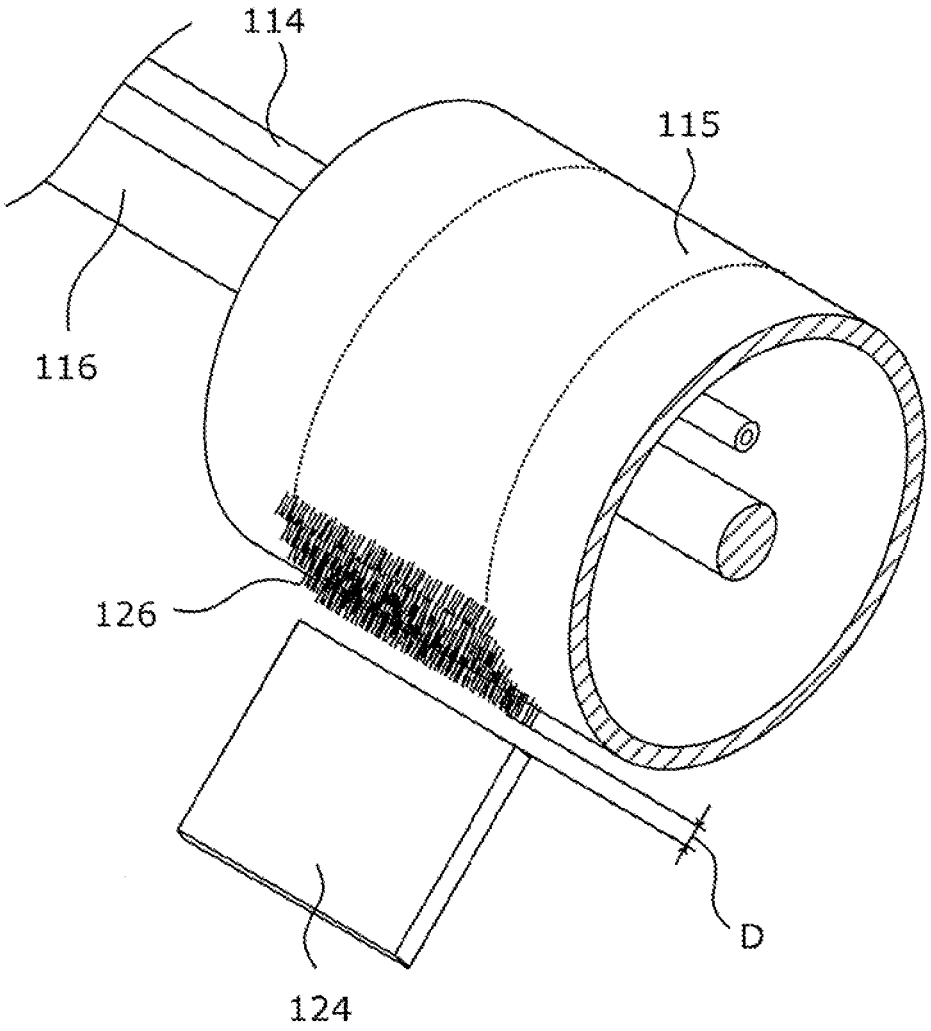
FIG. 7 is a perspective view schematically showing another embodiment.
Figure 8A:
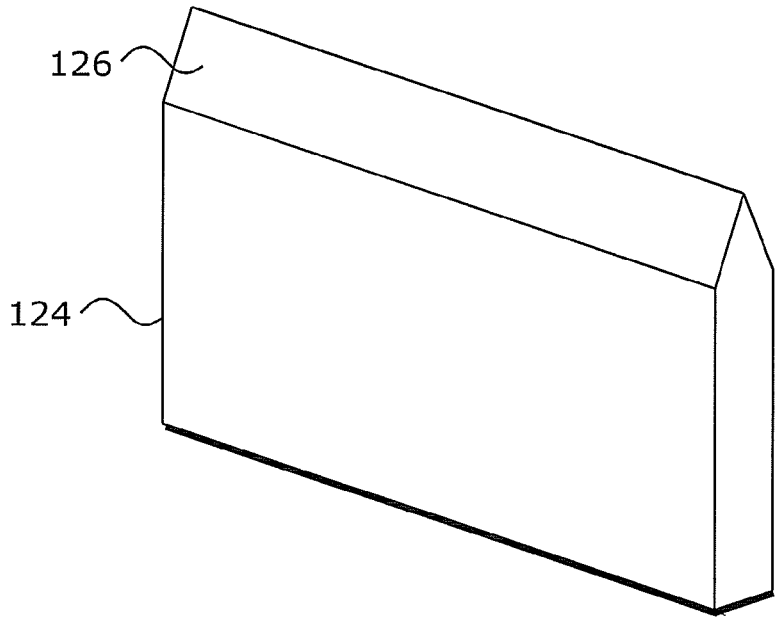
FIGS. 8(*a*) and 8(*b*) are perspective views showing variations of the pointed portion.
Figure 8B:
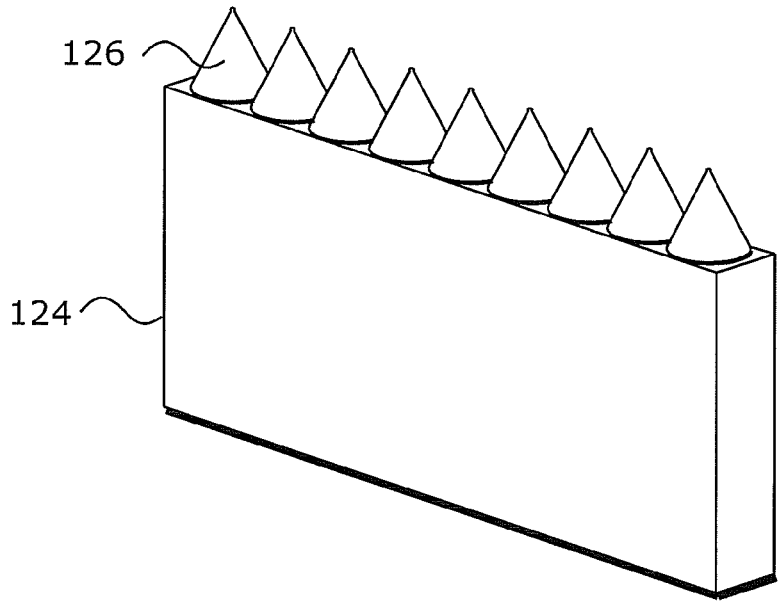

It is to be noted that, as shown in FIG. 7, the pointed portion 126 which is sharp at the tip may be provided on an entire circumference of the effusing body 115. Furthermore, the pointed portion 126 may be provided both on the effusing body 115 and the supplying electrode 124. In addition, the pointed portion 126 is not limited to a bundle of thin members 136 that is attached like hair, but other forms are possible as long as a tip is sharp or considered to be sharp and charge can be easily attracted. For example, the pointed portion 126 may be a knife-edge like shape as shown in FIG. 8(*a*) or the tip of the pointed portion 126 may be in a tiny spherical shape as shown in FIG. 8(*b*).

Figure 9:
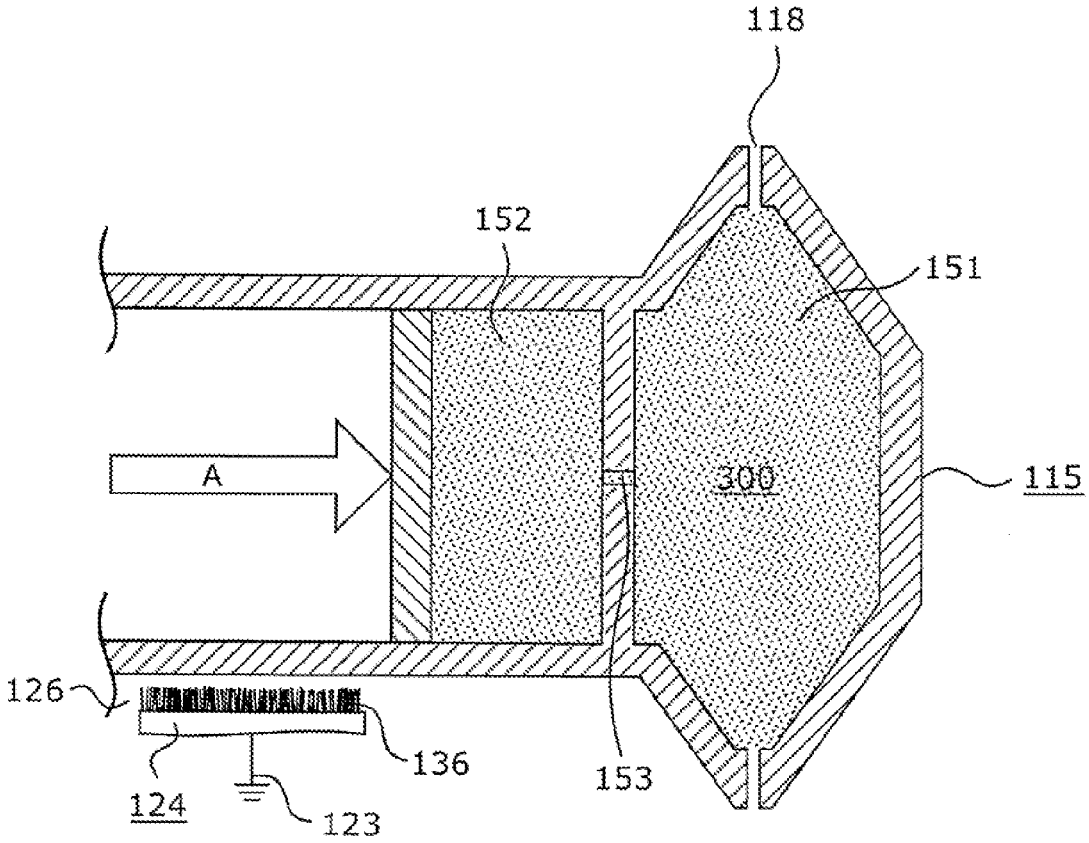
FIG. 9 is a cutaway plan view showing another embodiment of an effusing body.

Also, an area inside the effusing body 115 may be, as shown in FIG. 9, composed of: a leading-out area 151 which directly leads to the effusion hole 118; and a supplying area 152 which supplies the solution 300. The solution 300 may be supplied to the leading-out area 151 from the supplying area 152 via an inlet 153. Also, the solution 300 may be supplied by applying a pressure A to the solution 300 that is present in the supplying area 152. The pressure A may be applied by air through the use of an air compressor or the like. Also, the pressure A may be applied to the solution 300 using a pressure applying member such as a stem. Even when the effusing body 115 thus structured is adopted, the supplying electrode 124 is placed at a distance D from the effusing body 115. Furthermore, as shown in FIG. 9, the effusion hole 118 may be placed at a projecting part of the effusing body 115. Also, the effusion holes 118 may be provided on an entire circumference of the effusing body 115 at equal intervals in only a single row in a direction of the rotary shaft.

It is to be noted that, to allow the effusing body 115 to be grounded, the supplying electrode 124 is connected to the grounding device 123, and a predetermined voltage is applied to the charging electrode 121 using the charging power source 122 in the above embodiment; however, the present invention is not limited to this. Similar advantage as disclosed in the above embodiment of the present invention can be obtained by applying a predetermined voltage to the effusing body 115 side via the supplying electrode 124, which is placed at a predetermined distance from the effusing body, and grounding the charging electrode 121.

The present invention is applicable to production of nanofibers, and spinning and production of nonwoven fabrics using nanofibers.

The invention claimed is:

1. A nanofiber production device which produces nanofibers by stretching, in a space, a solution, said nanofiber production device comprising:

an effusing body which effuses the solution into the space by centrifugal force;

a driving source which rotates said effusing body;

a supplying electrode which supplies charge to the solution via said effusing body, said supplying electrode being placed at a predetermined distance from said effusing body;

a charging electrode to which a potential of reverse polarity to a polarity of said effusing body is applied, said charging electrode being placed at a predetermined distance from said effusing body;

a charging power source which applies a predetermined voltage between said supplying electrode and said charging electrode;

a collecting device which collects the nanofibers; and an attracting device which attracts the nanofibers to said collecting device.

2. The nanofiber production device according to claim 1, wherein said supplying electrode is placed at a distance from said effusing body, the distance being in a range where electrical conduction between said supplying electrode and said effusing body is ensured.

3. A nanofiber production device which produces nanofibers by stretching, in a space, a solution, said nanofiber production device comprising:

an effusing body which effuses the solution into the space by centrifugal force;

a driving source which rotates said effusing body;

a supplying electrode which supplies charge to the solution via said effusing body, said supplying electrode being placed at a predetermined distance from said effusing body, a charging electrode to which a potential of reverse polarity to a polarity of said effusing body is applied, said charging electrode being placed at a predetermined distance from said effusing body, and a charging power source which applies a predetermined voltage between said supplying electrode and said charging electrode, wherein said supplying electrode includes a pointed portion which is sharp at a tip and oriented toward said effusing body.

4. The nanofiber production device according to claim 3, wherein said pointed portion extends toward said effusing body and consists of a plurality of members each having a needle-shaped tip or a thread-shaped tip.

5. A nanofiber production device which produces nanofibers by stretching, in a space, a solution, said nanofiber production device comprising:

an effusing body which effuses the solution into the space by centrifugal force;

a driving source which rotates said effusing body;

a supplying electrode which supplies charge to the solution via said effusing body, said supplying electrode being placed at a predetermined distance from said effusing body;

a charging electrode to which a potential of reverse polarity to a polarity of said effusing body is applied, said changing electrode being placed at a predetermined distance from said effusing body; and a charging power source which applies a predetermined voltage between said supplying electrode and said charging electrode, wherein said effusing body includes, in a portion opposing said supplying electrode, a receiving portion which is sharp at a tip and protrudes in a radial direction.

6. A nanofiber production method in which nanofibers are produced by stretching, in space, a solution, said nanofiber production method comprising:

effusing the solution, from an effusing body that is rotated by a driving source, into the space by centrifugal force;

supplying electric charge to the solution via the effusing body from a supplying electrode placed at a predetermined distance from the effusing body;

applying a predetermined voltage between a charging electrode and the supplying electrode using a charging power source, the charging electrode and the supplying electrode being placed at a predetermined distance from the effusing body;

attracting the nanofibers produced in the space to a collecting device using an attracting device; and collecting the nanofibers using the collective device.

* * * * *